US006478621B2

(12) United States Patent
Ma et al.

(10) Patent No.: US 6,478,621 B2
(45) Date of Patent: Nov. 12, 2002

(54) ELECTRICAL JACK RESISTING VOLTAGE SURGES

(75) Inventors: Xuedong Ma, Kunsan (CN); GuangXing Shi, Kunsan (CN)

(73) Assignee: Hon Hai Precision Ind. Co., Ltd., Taipei Hsieh (TW)

( * ) Notice: Subject to any disclaimer, the term of this patent is extended or adjusted under 35 U.S.C. 154(b) by 0 days.

(21) Appl. No.: 09/877,551

(22) Filed: Jun. 8, 2001

(65) Prior Publication Data

US 2002/0081901 A1 Jun. 27, 2002

(30) Foreign Application Priority Data

Dec. 21, 2000 (TW) ..... 89222250 U

(51) Int. Cl.[7] ..... H01R 13/648
(52) U.S. Cl. ..... 439/607; 676/540.1

(58) Field of Search ..... 439/607, 609, 439/676, 540.1, 344, 941

(56) References Cited

U.S. PATENT DOCUMENTS 6,203,379 B1 * 3/2001 Cai et al. ..... 439/676
6,210,235 B1 * 4/2001 Wu ..... 439/676
6,220,900 B1 * 4/2001 Huang ..... 439/676
6,290,535 B1 * 9/2001 Lin et al. ..... 439/607

* cited by examiner

*Primary Examiner*—Hien Vu
(74) *Attorney, Agent, or Firm*—Wei Te Chung

(57) ABSTRACT

A modular jack connector assembly (1) comprises an insulative housing (10), and a conductive outer shield (30). A first receiving space (11) is defined in the housing, for receiving a complementary modular plug. A plurality of first contacts (21) is disposed in the housing. Each first contact comprises a contact portion (21*a*), a bent portion (21*b*), and a tail portion (21*c*). An opening (35) is defined in the shield. The bent portions of the first spring contacts are exposed in the opening, such that a substantial gap exists between the bent portions and the shield. As a result, if high voltage is applied tithe shield, current cannot jump from the shield to the bent portions. Thus damage to other associated components of the system is avoided.

3 Claims, 5 Drawing Sheets

ELECTRICAL JACK RESISTING VOLTAGE SURGES

BACKGROUND OF THE INVENTION

1. Field of the Invention

The present invention relates to electrical jack connectors, and particularly to modular jack connectors which can withstand high voltage shocks caused by events such as lightning strikes.

2. Description of the Prior Art

Modular jacks frequently comprise RJ-45 connectors for network data transmission and RJ-11 connectors for telephone signal transmission. Jack connectors are typically positioned proximate an edge portion of a circuit board, for mating with complementary modular plugs. Referring to FIG. 1, a conventional jack connector assembly 8 comprises an insulative housing 80 and receiving portions 81, 82 defined therein to receive RJ-45 and RJ-11 plugs respectively. First and second contact inserts 83, 84 are mounted in the receiving portions 81, 82 from a rear of the insulative housing. The first and second inserts 83, 84 have similar structure. The first insert 83 has four contacts 830, and the second insert 84 has eight contacts. Each contact 830 has a contact portion 833 for electrically engaging with an RJ-11 plug for telephone signal transmission. A bent portion 832 is exposed in an upper, rear part of the insulative housing 80, and is spaced about 0.3 mm from an outer shield 85 that surrounds the insulative housing 80 (as shown in FIG. 2).

Because the RJ-11 connector is used in a telephone network, it is susceptible to lightning strikes occurring on an associated telephone line. When this happens, the resultant very high voltage of, say, 1500 volts may cause electrical current to jump across the 0.3 mm gap from the outer shielding 85 to the bent portions 832 of the contacts 830. If so, the current surge enters the circuit board through the tail portions 831 of the contacts 830, frequently resulting in damage to electrical circuitry and components on the circuit board.

The abovementioned problem could be solved simply by increasing the size of the gap. However, such solution would not be practicable because it goes against the modem trend toward miniaturization of electronic devices.

Thus a compact RJ-45 modular jack connector which resists voltage surges is desired.

SUMMARY OF THE INVENTION

An object of the present invention to provide a modular jack assembly including juxtaposed RJ-11 and RJ-45 modular jacks, in which the RJ11 modular jack is compact yet still withstands high voltages caused by lightning strikes on associated telephone networks.

To achieve the above object, a modular jack connector assembly of the present invention comprises an insulative housing, first and second contact inserts, and a conductive outer shield. The housing defines first and second receiving spaces, for respectively receiving an RJ-11 and an RJ-45 modular plug therein. The contact inserts are mounted in the housing. One contact insert has four contacts for engaging with the RJ-11 modular plug, while the other contact insert has eight contacts for engaging with the RJ-45 modular plug. A shield encloses the housing to protect the contacts from electromagnetic interference. Each RJ-11 modular plug engaging contact has an upper, rear bent portion which is neither covered by the housing nor embedded in the insert. The shield defines an opening therein. The opening is disposed above the upper, rear bent portions of the RJ-11 modular plug engaging contacts, such that a substantial gap exists between the shield and the bent portions. Thus when high voltage is applied to the shield as a result of a lightning strike on an associated telephone line, current cannot jump from the shield to the bent portions of the contacts. Therefore no damage is sustained to electrical circuitry or components on a circuit board on which the modular jack assembly is mounted.

DESCRIPTION OF PREFERRED EMBODIMENT OF THE INVENTION

Figure 1:
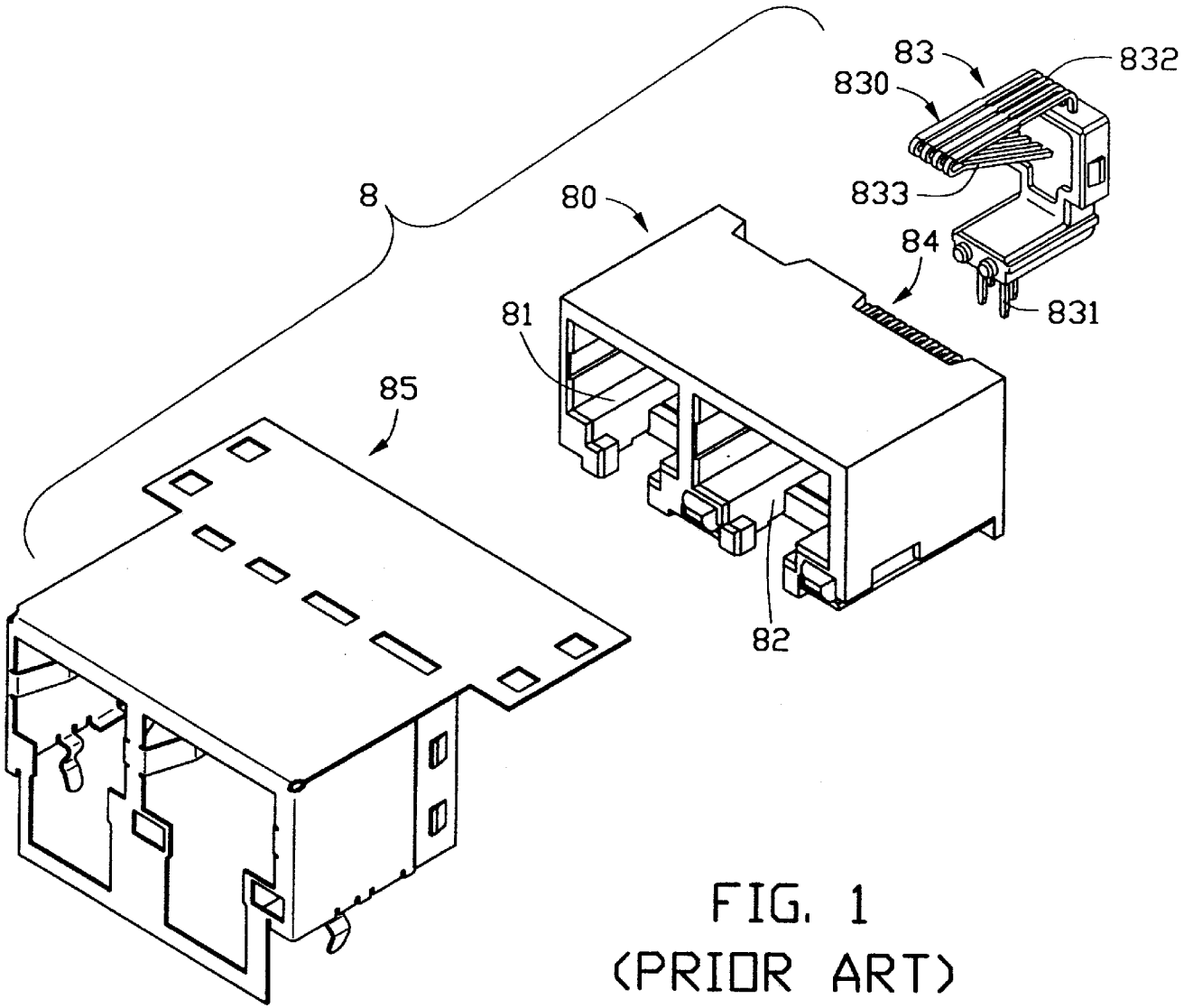
FIG. 1 (PRIOR ART)
FIG. 1 is an exploded perspective view of a conventional modular jack assembly.
Figure 2:
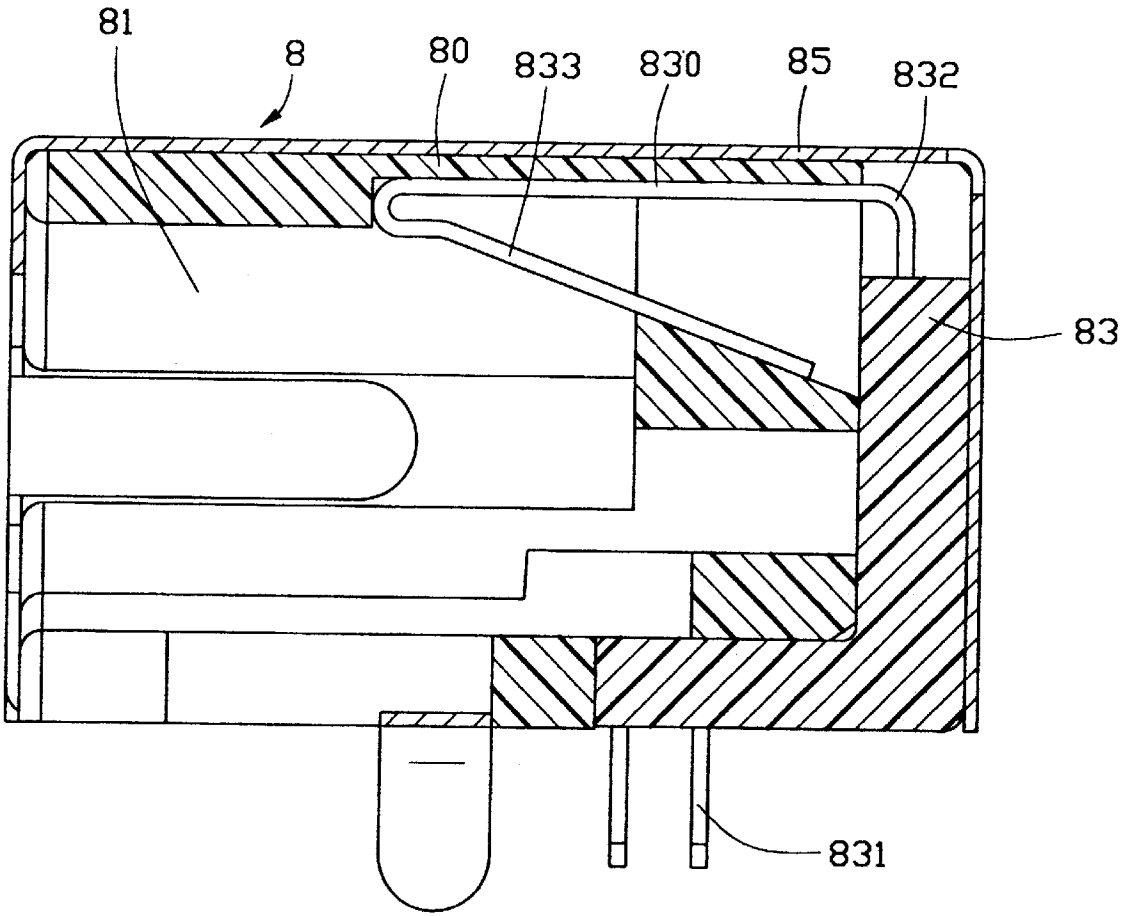
FIG. 2 (PRIOR ART)
FIG. 2 is a cross-sectional view taken along line II—II of FIG. 1.
Figure 3:
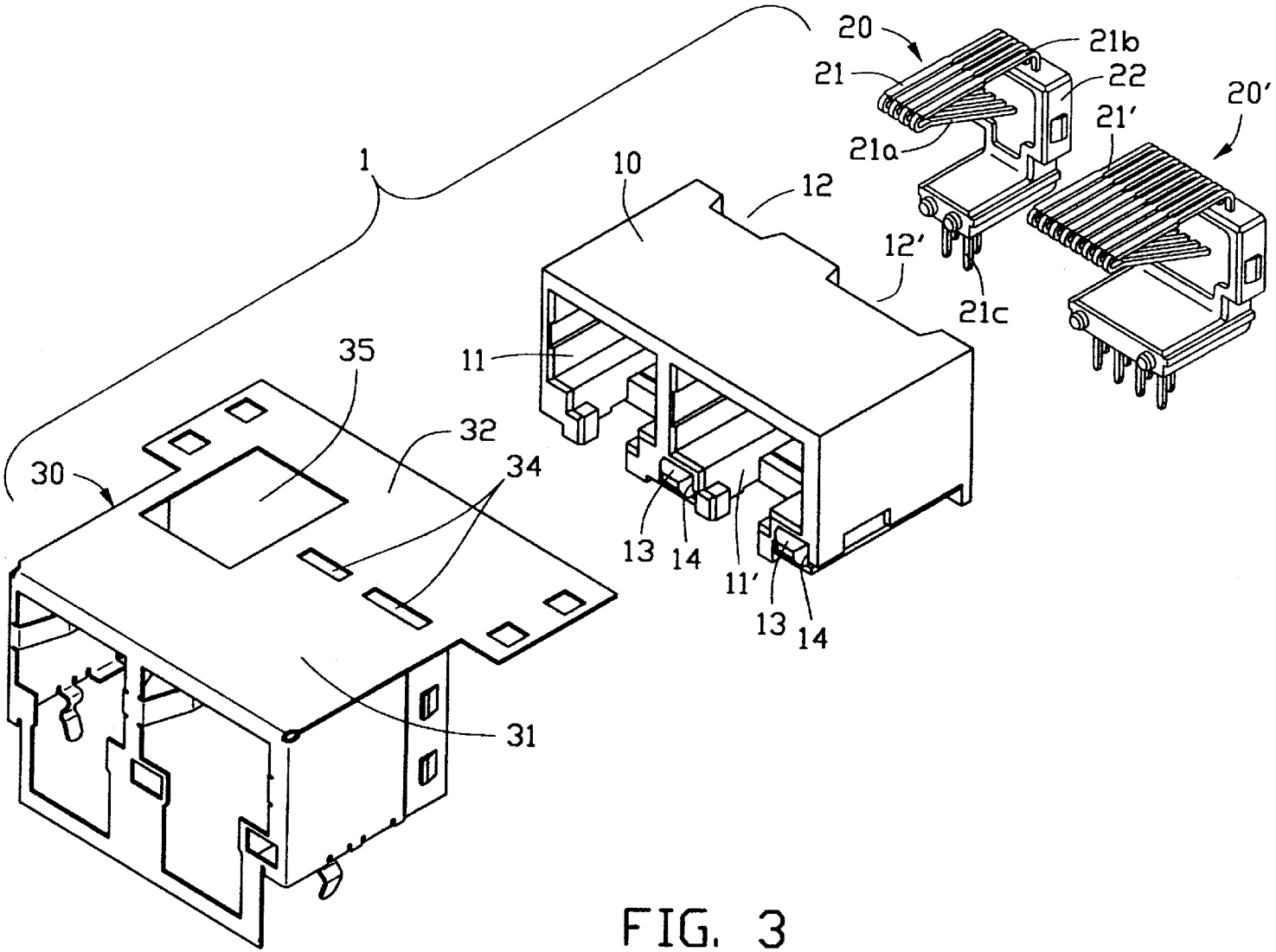
FIG. 3 is an exploded perspective view of a modular jack assembly in accordance with the present invention.
Figure 4:
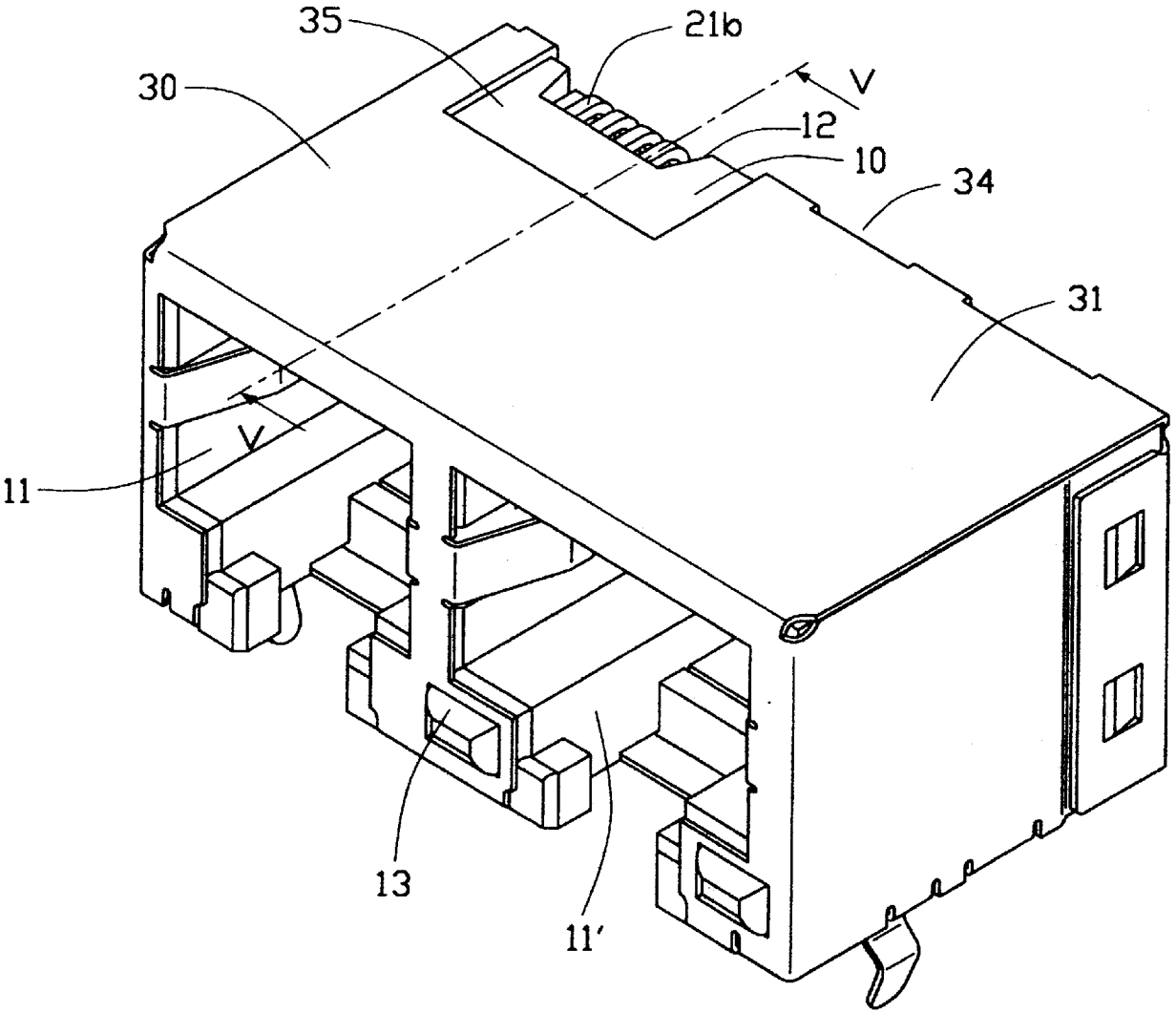
FIG. 4 is an assembled view of the modular jack assembly of FIG. 3.
Figure 5:
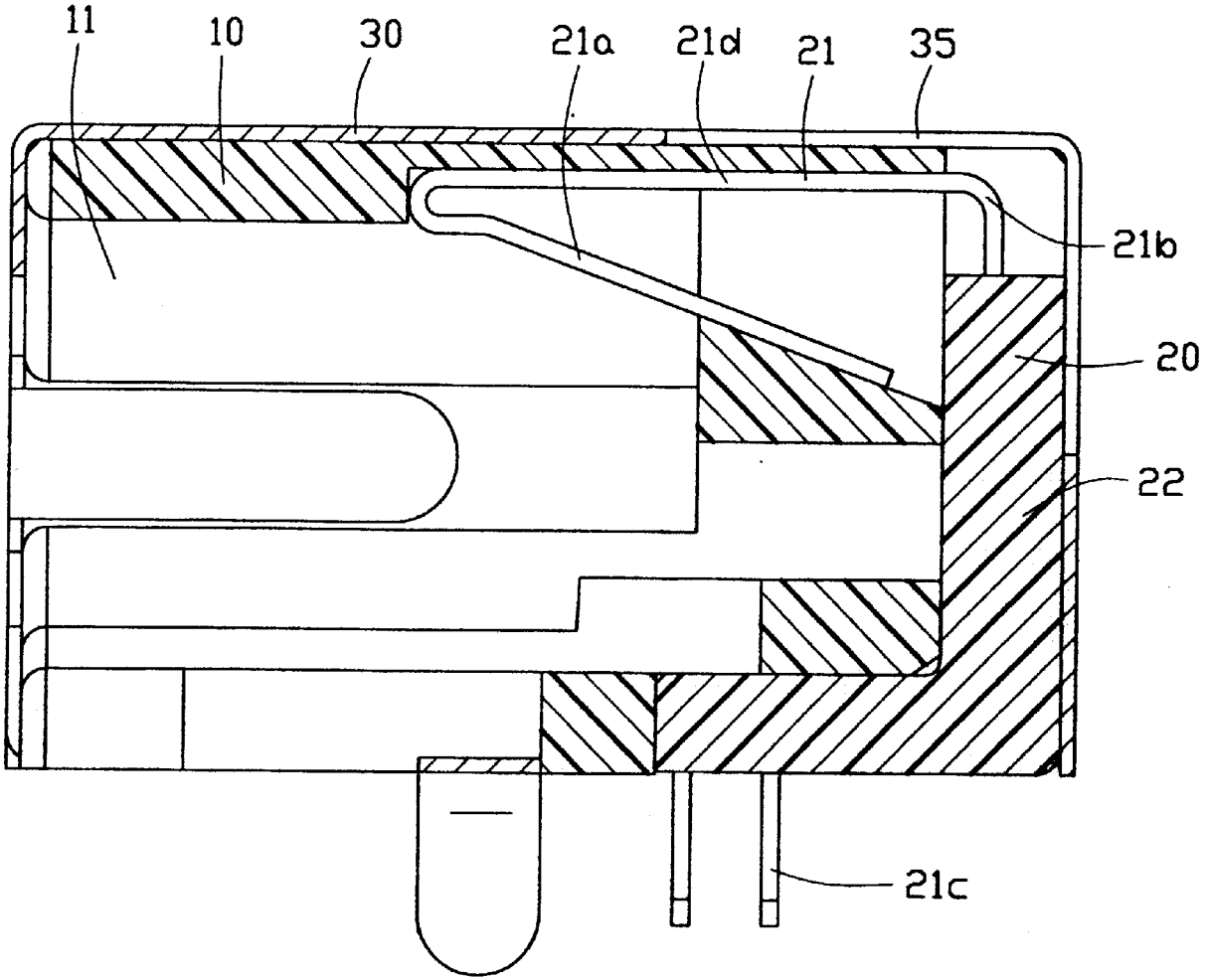
FIG. 5 is a cross-sectional view taken line V—V of FIG. 4.

As shown in FIGS. 3 to 5, a modular jack assembly 1 in accordance with the present invention comprises an insulative housing 10, first and second contact inserts 20, 20' and a conductive outer shield 30. First and second receiving spaces 11, 11' are defined in the housing 10. The first and second receiving spaces 11, 11' are configured to receive an RJ-11 modular plug (not shown) and an RJ-45 modular plug (not shown) respectively. First and second cutouts 12, 12' are defined in a rear wall of the insulative housing 10, in communication with the first and second receiving spaces 11, 11' respectively. A pair of slots 14 is defined in a bottom wall (not labeled) of the insulative housing 10 on opposite sides of the second receiving space 11' respectively, for receiving a pair of light emitting diodes (LEDs) 13 therein.

The first contact insert 20 comprises four first contacts 21 which are over molded in a plastic block 22 and can be connected to a telephone network through an RJ-11 modular plug electrically engaging with the first contacts 21. Each contact 21 comprises a horizontal connecting portion 21*d*, an upper, rear bent portion 21*b*, a slanted contact portion 21*a* which extends rearwardly and downwardly from a front end of the horizontal connecting portion 21*d*, and a tail portion 21*c* extending downwardly from the bent portion 21*b* beyond a bottom surface of the plastic block 22. The contact portion 21*a* is used to electrically engage with the RJ-11 plug connector. The second contact insert 20' is similar to prior art, so a detailed description thereof is omitted herein. In pre-assembly, the first and second contact inserts 20, 20' are mounted in the insulative housing 10. The first and second contact inserts 20, 20' are respectively inserted into the first and second receiving spaces 11, 11' through the first and second cutouts 12, 12'. The contact portions 21*a* of the first contact 21 project into the first receiving space 11 of the housing 10. The tail portions 21*c* are disposed below a bottom face of the housing 10. The bent portions 21*b* are disposed in the first cutout 12 of the housing 10.

The first contact insert 20 comprises four first contacts 21 which are over molded in a plastic block 22 and can be connected to a telephone network through an RJ-11 modular plug electrically engaging with the first contacts 21. Each contact 21 comprises a horizontal connecting portion 21*d*, an upper, rear bent portion 21*b*, a slanted contact portion 21*a* which extends rearwardly and downwardly from a front end of the horizontal connecting portion 21*d*, and a tail portion 21*c* extending downwardly from the bent portion 21*b* beyond a bottom surface of the plastic block 22. The contact portion 21*a* is used to electrically engage with the RJ-11 plug connector. The second contact insert 20' is similar to prior art, so a detailed description thereof is omitted herein. In pre-assembly, the first and second contact inserts 20, 20' are mounted in the insulative housing 10. The first and second contact inserts 20, 20' are respectively inserted into the first and second receiving spaces 11, 11' through the first and second cutouts 12, 12'. The contact portions 21*a* of the first contact 21 project into the first receiving space 11 of the housing 10. The tail portions 21*c* are disposed below a bottom face of the housing 10. The bent portions 21*b* are disposed in the first cutout 12 of the housing 10.

An outer shielding 30 is used to enclose the insulative housing 10. The shield 30 comprises a rear wall 32 and a top wall 31. Two aligned narrow holes 34 are defined at a junction between the rear and top walls 32, 31, corresponding to the second cutout 12' of the housing 10. The holes 34 are aligned along a bending axis (not labeled) of the shield 30. A rectangular opening 35 is defined in a region covering both the rear and top walls 32, 31, corresponding to the first cutout 12 of the housing 10.

In assembly, the shield 30 is mounted on the housing 10 to enclose the housing 10. The rear wall 32 is bent 90 degrees downwardly about the bending axis, with the holes 34 and the opening 35 facilitating the bending operation. The opening 35 of the shield 30 is positioned above an upper portion of the first cutout 12, and corresponding to the bent portions 21*b* of the first contacts 21. Thus the bent portions 21*b* are disposed below the opening 35. The bent portions 21*b* are exposed in the opening 35 such that a gap between the bent portions 21*b* and the shield 30 is greater than a space between any two adjacent first contacts 21. In the preferred embodiment, the bent portions 21*b* are spaced from the shield 30 a distance of at least 2.5 mm. Therefore, when high voltage is applied to the shield 30, the resultant current cannot jump across the gap between the shield 30 and the bent portions 21*b*. The contacts 21 remain unaffected, thereby preventing damage to any electrical components of a circuit board on which the modular jack assembly 1 is mounted. In high voltage shock tests, the modular jack assembly 1 constructed in accordance with the present invention has been shown to withstand electrical shock in the range of 2500–2900 volts. This is far higher than the generally accepted rating of 1500 volts.

What is claimed is:

1. A modular jack connector comprising:

an insulative housing, at least one receiving space defined in the housing for insertion of a complementary plug connector thereinto;

a plurality of first contacts secured in the housing, each first contact comprising a contact portion extending into the receiving space, a bent portion positioned in a rear of the housing such that the bent portion is exposed, and a tail portion protruding from a bottom surface of the housing;

an outer shield enclosing the housing, an opening being defied in the shield, the bent portions being exposed in the opening such that a gap between the bent portions and edges of the opening of the shield is greater than a space between any two adjacent first contacts; wherein a second receiving space is defined in the housing, and a plurality of second contacts is received in the second receiving space; wherein the first and second contacts are disposed in a first contact insert and a second contact insert respectively; wherein the gap is more than 2.5 mm.

2. The modular jack connector according to claim 1, wherein a first and a second cutout are defined in a rear surface of the housing.

3. The modular jack connector according to claim 1, wherein the first and second contact inserts are secured in the first and second receiving spaces respectively.

* * * * *